US005124007A

United States Patent [19]

Tsuchiya et al.

[11] Patent Number: 5,124,007

[45] Date of Patent: Jun. 23, 1992

[54] COMPOSITE PLATING BATH

[75] Inventors: Takeji Tsuchiya, Urawa; Motonobu Onoda, Gunma; Katsuaki Ogawa, Warabi, all of Japan

[73] Assignee: Nippon Piston Ring Co., Ltd., Tokyo, Japan

[21] Appl. No.: 684,679

[22] Filed: Apr. 8, 1991

[30] Foreign Application Priority Data

Jul. 18, 1990 [JP] Japan ..... 2-188045

[51] Int. Cl.[5] ..... C25D 3/12

[52] U.S. Cl. ..... 205/109; 205/259

[58] Field of Search ..... 204/49

[56] References Cited

FOREIGN PATENT DOCUMENTS 56-18080 4/1981 Japan .
11998 1/1989 Japan .
21097 1/1989 Japan .

*Primary Examiner*—T. M. Tufariello
*Attorney, Agent, or Firm*—Birch, Stewart, Kolasch & Birch

[57] ABSTRACT

A composite plating bath prepared by adding an agent of boron compounds, such as trimethylamine-borane, dimethylamine-borane and sodium borohydride, by an amount of 0.1 to 10 grams/liter, preferably 1 to 8 grams/liter to a usual nickel electroplating bath having an aqueous acidic solution of at least one nickel salt and micron size particles of at least one water-insoluble material.

8 Claims, 2 Drawing Sheets

COMPOSITE PLATING BATH

BACKGROUND OF THE INVENTION

The present invention relates to a composite electroplating bath to deposit a composite nickel plate composed of a nickel alloy matrix and eutectoid particles dispersed in the matrix on the metal surface.

The composite plating bath is desired to deposit a composite plate in which the particles are effective to improve the plate in physical properties. Such a bath has been disclosed by JP B 56-18080 that is prepared by adding a water soluble addition agent containing phosphorus compounds by an amount of 0.1–4.2 grams/liter to a usual nickel electroplating bath including eutectoid particles.

The bath, as disclosed above, coats the metal surface with a composite plate composed of a nickel-phosphorus alloy matrix and eutectoid particles of alumina, silicon and/or nitride dispersed in the matrix. The plate is superior in hardness and anti-abrasion properties to the conventional plate obtained from the usual bath without the phosphorus agent. However, it is still insufficient as a plate covering a slidable member subjected in service to a high load at high temperatures, such as a piston ring for use in an internal combustion engine. The member or piston ring, when plated in the aforementioned bath, is somewhat unreliable in hardness and anti-abrasion without the anti-abrasion without the help of a proper heat-treatment.

SUMMARY OF THE INVENTION

The present invention is intended to solve the problem as described. It is the principal object of the present invention to provide an improved composite plating bath that is fit to plate the slidable member, such as piston rings for use in an internal combustion engine. The other object is to provide an improved composite bath to deposit a composite plate on the metal surface of the slidable member that is available under severe conditions without any heat-treatment.

In order to attain the objects, the invention consists in a composite plating bath prepared by adding an addition agent of boron compounds by an amount of 0.1 to 10 grams/liter to a nickel electroplating bath including eutectoid particles.

REFERENCE TO THE DRAWINGS

DETAILED DESCRIPTION OF THE INVENTION

Figure 1:
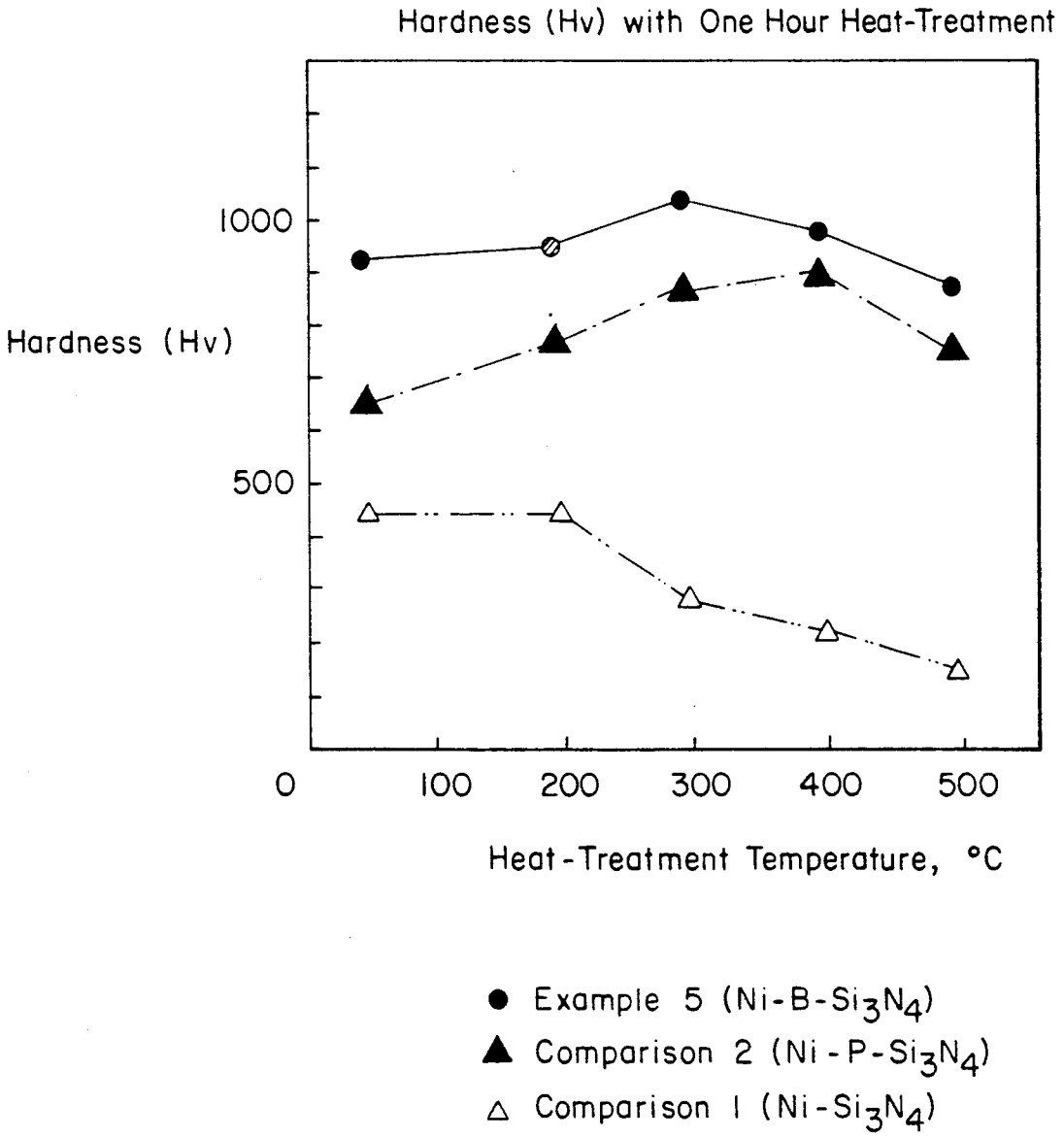
FIG. 1 is a graph illustrating the results of a hardness test.

In accordance with the invention, the basic nickel electroplating bath is an aqueous acidic solution of at least one nickel salt. The bath is not specified but usual as shown below:

(1) Watt Bath
nickel sulfate: 220–370 grams/liter
nickel chloride: 30–60 grams/liter
boric acid: 30–60 grams/liter (2) Nickel Sulfamate Bath
nickel sulfamate: 225–525 grams/liter
nickel chloride: 15–38 grams/liter
boric acid: 30–45 grams/liter (3) Weissberg Bath
nickel sulfate: 240–300 grams/liter
nickel chloride: 30–45 grams/liter
boric acid: 30–40 grams/liter
cobalt sulfate: 25–15 grams/liter
formic acid: 25–30 grams/liter
formalin: 1.5–2.5 grams/liter.

Eutectoid particles are added by a range of 20 to 200 grams/liter to the basic bath to deposit a composite plate. The range is the same as usual. When the particles are added by less than 20 grams/liter, they are insufficient in quantity. But, when the particles are added by more than 200 grams/liter to the bath, the composite plate will be too rough, brittle and poor in strength to be practically used. No practical plate will be obtained when the additive amount of the particles is out of the range as described above. The particles usually consist of one or more selected from among Ni—$Si_3N_4$, Ni—SiC, Ni—WC and the like.

The inventive bath is prepared by adding an agent of boron compounds by an amount of 0.1 to 10 grams/liter, preferably 1 to 8 grams/liter to the basic bath with the particles. The boron compounds are consist of one or more selected from among trimethylamine-borane $(CH_3)_3NBH_3$, dimethylamin-borane $(CH_3)_2HNBH_3$, and sodium borohydride $NaBH_4$. The composite bath is easy to deposit an improved composite plate that is superior in hardness, anti-abrasion and heat-resistance.

Advantages offered by the invention are that the composite plating bath containing boron compounds produces a composite plate improved in hardness and anti-abrasion and that the composite bath is suitable to plate the metal surface of slidable members subjected in service to a high load at high temperatures, such as piston rings for use in an internal combustion engine. The composite plate from the inventive bath is also improved in heat-resistant property as compared with that from the conventional bath with an addition agent of phosphorus compounds. The slidable member plated in the inventive bath is utilizable under severe conditions without a heat-treatment or with a low-temperature heat-treatment. This means that the bath reduces the cost of production of the slidable member or piston ring.

EXAMPLE

The following examples illustrate the invention, wherein trimethylamine-borane is called "TMAB" for short.

| | |
|---|---|
| 1) Plating Conditions: | |
| temperatures: 55° C., | pH: 3.5 |
| 2) Bath Compositions: | |
| Comparison 1: nickel sulfate | 240 grams/liter |
| nickel chloride | 45 grams/liter |
| boric acid | 30 grams/liter |
| silicon nitride | 100 grams/liter |
| ($Si_3N_4$: 0.7 micron average particle size) | |
| Comparison 2: hypophosphorous acid added to the composition of Comparison 1 | 3.0 grams/liter |
| Example 1: TMAB added to the composition of Comparison 1 | 0.5 grams/liter |
| Example 2: TMAB added to the composition of Comparison 1 | 1 grams/liter |
| Example 3: TMAB added to the composition of Comparison 1 | 2 grams/liter |
| Example 4: TMAB added to the composition of Comparison 1 | 4 grams/liter |
| Example 5: TMAB added to the composition of Comparison 1 | 6 grams/liter |

-continued

| | |
|---|---|
| Example 6: TMAB added to the composition of Comparison 1 | 8 grams/liter |
| Example 7: TMAB added to the composition of Comparison 1 | 10 grams/liter |

The respective composite plates were obtained from Comparisons and Examples. The inventive baths are also obtainable by adding TMAB to Comparison 1 from which boric acid is removed and deposit the same hard plates. However, the composite bath preferably includes boric acid to lengthen its life and maintain its stability.

HARDNESS TEST

The individual plates obtained from the nine Comparisons and Examples were tested with Micro Vickers Hardness Tester before and after being subjected to one hour heat-treatment at preselective temperatures. The test results are shown in

TABLE 1

| HARDNESS (Hv) OF PLATE | | | | | |
|---|---|---|---|---|---|
| | on or before treatment | after treatment heat-treatment temperature | | | |
| | | 200° C. | 300° C. | 400° C. | 500° C. |
| Comparison 1 | 453 | 441 | 282 | 210 | 169 |
| Comparison 2 | 633 | 770 | 884 | 895 | 731 |
| Example 1 | 895 | 905 | 972 | 832 | 725 |
| Example 2 | 910 | 917 | 1015 | 915 | 833 |
| Example 3 | 918 | 920 | 1020 | 933 | 871 |
| Example 4 | 928 | 936 | 1028 | 966 | 880 |
| Example 5 | 935 | 948 | 1032 | 970 | 875 |
| Example 6 | 930 | 941 | 1030 | 976 | 878 |
| Example 7 | 933 | 945 | 1025 | 968 | 871 |

The results of Comparisons 1 and 2 and Example 5 are plotted in FIG. 1. The test results show that the plates from Comparisons 1 and 2 containing no agent of boron compounds are poor in hardness before the heat-treatment and that the plate from Comparison 1 reduces its hardness when treated at temperatures higher than 300° C. On the other hand, the plates from Example 5 containing the agent of boron compounds has a sufficient hardness without or before the heat-treatment and maintains its hardness after heat-treated at temperatures of 300° to 350° C. This means that the addition of boron compounds also improves the plate in heat-resistance.

The plate from Comparison 2 with the phosphorus agent is better in hardness than that from Comparison 1 without the phosphorus agent. But, it is inferior in hardness to that from Example 5 even before being heat-treated. This means that the bath with the boron agent is more advantageous than the bath with the phosphorus agent to deposit a composite plate on sliding members. If the plate from the latter were deposited on the slidable member for use under severe conditions, it would be unavailable without being heat-treated at temperatures of 350° to 380° C. The plate from the inventive bath is available without heat-treatment when deposited on the same member. It can be heat-treated at a temperature of 300° C. or less if a heat-treatment is desired. This means that the plating cost can be reduced.

ABRASION TEST

The plates from Comparisons 1 and 2 and Example 5 were tested under an abrasion condition as shown in Table 2:

TABLE 2

| ABRASION TEST CONDITION: | |
|---|---|
| tester | AMSLER ABRASION TESTER |
| method | rotary contact piece half immersed in oil and loaded |
| rotary contact piece | FC25 (HRB98) |
| lubricant oil | 10W30 |
| oil temperature | room temperature |
| peripheral speed | 0.89 m/sec (500 rpm) |
| load | 60 Kg |
| abrasion amount | difference in level (micron) measured by a contact profile meter |

Figure 2:
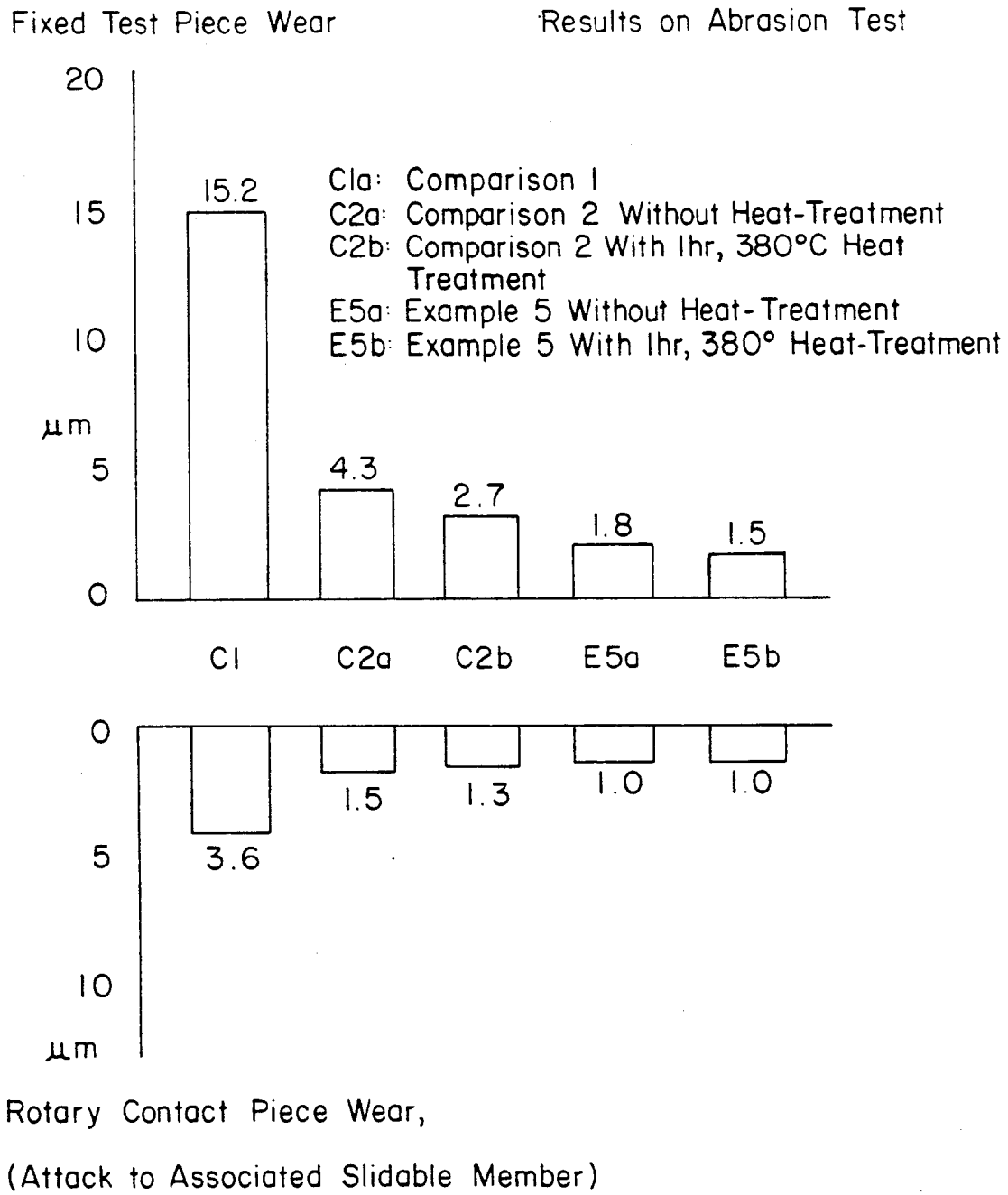
FIG. 2 is a graph illustrating the results of an abrasion test

In Amsler tester the test piece was fixed, while the rotary contact piece was rotated. The rotary piece is doughnut-shaped with 40 mm outer diameter, 16 mm inner diamter, and 10 mm thickness. The rotary piece was arranged to contact the plate on the test piece. The test results are plotted in FIG. 2. It will be understood from FIGS. 1 and 2 that the agent of boron compounds improves the composite plate in hardness and anti-abrasion. Accordingly, the inventive bath is most desirable to deposit a composite plate on slidable members which are used under severe sliding and high-temperature conditions that dominate in an internal combustion engine.

It is noted that the boron agent is effective by a very small amount to improve the physical and chemical properties of the plate. For instance, the advantage as described above is obtained by an addition of only 0.1 grams/liter of boron compounds (TMAB). But, an addition of more than 10 grams/liter of boron compounds increases the plating stress with the result that the plate becomes brittle. Accordingly, the addition of the boron agent should be within a range of 0.1 to 10 grams/liter, more preferably 1 to 10 grams/liter.

From the foregoing, the composite plating bath of the present invention is easily prepared by adding the boron agent to the usual composite nickel plating bath. The inventive composite bath produces an improved composite plate of nickel-boron alloy which is superior in hardness and anti-abrasion without being heat-treated to the conventional plate from the usual bath containing the phosphorus agent.

What is claimed is:

1. A composite plating bath comprising an aqueous acidic solution of at least one nickel salt and particles of at least one water insoluble material, said bath being prepared by adding an agent composed of boron compounds by an amount of 0.1 to 10 grams/liter.

2. A composite plating bath as claimed in claim 1, wherein said boron compounds are selected from a group consisting of trimethylamine-borane, dimethylamine-borane, and sodium borohydride.

3. A composite plating bath as claimed in claim 1, which comprises said particles by an amount of 20 to 200 grams/liter.

4. A composite plating bath as claimed in claim 1, wherein said particles consist of one or more selected from among Ni—$Si_3N_4$, Ni—SiC, and Ni—WC.

5. A composite plating bath comprising an aqueous acidic solution of at least one nickel salt and particles of at least one water insoluble material, said bath being prepared by adding an agent composed of boron compounds by an amount of 1 to 8 grams/liter.

6. A composite plating bath as claimed in claim 4, wherein said boron compounds are selected from a group consisting of trimethylamine-borane, dimethylamine-borane, and sodium borohydride.

7. A composite plating bath as claimed in claim 4, which comprises said particles by an amount of 20 to 200 grams/liter.

8. A composite plating bath as claimed in claim 4, wherein said particles consist of one or more selected from among Ni-$Si_3N_4$, Ni-SiC, and Ni-WC.

* * * * *